US006465947B1

(12) United States Patent
Tojo et al.

(10) Patent No.: US 6,465,947 B1
(45) Date of Patent: Oct. 15, 2002

(54) COLOR PICTURE TUBE

(75) Inventors: Toshio Tojo, Ichinomiya (JP); Nobuhiko Hosotani, Mobara (JP); Masahiro Nishizawa, Mobara (JP); Norikazu Uchiyama, Chikura (JP); Maki Taniguchi, Ichihara (JP)

(73) Assignees: Hitachi, Ltd., Tokyo (JP); Hitachi Device Engineering Co., Ltd., Mobara (JP)

( * ) Notice: Subject to any disclaimer, the term of this patent is extended or adjusted under 35 U.S.C. 154(b) by 0 days.

(21) Appl. No.: 09/493,079

(22) Filed: Jan. 28, 2000

(51) Int. Cl.[7] ..... H01J 29/88

(52) U.S. Cl. ..... 313/478; 313/477; 313/479; 313/48

(58) Field of Search ..... 313/478, 477, 313/479, 480; 430/26, 27

(56) References Cited

U.S. PATENT DOCUMENTS 5,789,854 A * 8/1998 Takizawa et al. ..... 313/478
5,939,821 A * 8/1999 Itou et al. ..... 313/461
6,016,028 A * 1/2000 Iguchi et al. ..... 313/402
6,043,599 A * 3/2000 Nakane ..... 313/479
6,268,704 B1 * 7/2001 Nishizawa et al. ..... 315/366
6,348,770 B1 * 2/2002 Nishizawa et al. ..... 315/366
6,351,062 B1 * 2/2002 Nishizawa et al. ..... 313/478
6,359,380 B1 * 3/2002 Nishizawa et al. ..... 313/479
6,366,012 B1 * 4/2002 Lee et al. ..... 313/466

* cited by examiner

*Primary Examiner*—Sandra O'Shea
*Assistant Examiner*—Anabel Ton
(74) *Attorney, Agent, or Firm*—Antonelli, Terry, Stout & Kraus, LLP

(57) ABSTRACT

A panel has a flat external surface and has a curvature on an inner surface thereof. A coating having light absorption characteristics is formed on the external surface of the panel. To the top of the coating, a film which has light absorbing characteristics and contains an adhesive is adhered. The light absorption by the coating is large at the central portion of the panel and is small at the peripheral portion of the panel. The light absorption characteristics of the film is approximately uniform on the entire surface of the panel. Due to such a constitution, a color picture tube having a flat external surface, the least brightness difference and an excellent contrast can be realized.

23 Claims, 4 Drawing Sheets

COLOR PICTURE TUBE

FIELD OF THE INVENTION

The present invention relates to a color picture tube, and more particularly to a color picture tube having a flat external surface, the least brightness difference and an excellent contrast.

BACKGROUND OF THE INVENTION

For providing the enhancement of the luminosity factor of a screen, the prevention of the glare due to the reflection of external light and the like, a color picture tube with a flat panel surface has been developed. From a viewpoint of assuring the mechanical strength against the atmospheric pressure while maintaining the flat external surface, it is necessary to make the thickness of the glass at the peripheral portion of a panel thicker than the thickness of the glass at the central portion of the panel. Furthermore, in case a shadow mask which is shaped by a press is adopted, a curvature is necessary for assuring the mechanical strength of the curved surface of the shadow mask. For this end, it is necessary to provide a curvature to the inside of the panel. From this aspect, the thickness of the peripheral portion of the panel becomes greater than the thickness of the central portion. However, since the panel glass absorbs light, the difference of thickness of the glass appears as the difference of the brightness between the peripheral portion and the central portion and hence, the image quality of the displayed image is deteriorated.

To compensate for this drawback, there have been following prior arts. U.S. Pat. No. 5,660,876, Japanese Laid-Open Publication Hei 5-299034/1993 and Japanese Laid-Open Publication Hei 5-182602/1993 disclose a constitution where a visible light absorption layer is formed of a black dye and the density of the black dye is higher at the central portion than the peripheral portion of a panel thus making the brightness uniform. In this method, the light absorption for enhancing the contrast of a displayed image and the correction of the grading of the brightness are both performed by a black dye layer. In case the light absorption is increased by the single film in such a manner, however, it is inevitable to increase the light absorption coefficient of the film and hence, the light from a phosphor is reflected by the absorption layer (back surface reflection) so that the deterioration of focusing and a ghost phenomenon occur thus degrading the displayed image.

Japanese Laid-Open Publication Hei 11-283531/1999 discloses a constitution where a colored film having a varied density is stuck to the surface of a panel such that the difference of transmittance of the panel glass can be compensated for. This has a problem that color films having various transmittance grading must be prepared for respective color cathode ray tubes.

Japanese Laid-Open Publication Hei 11-307016/1999 further discloses a constitution where a functional film which changes the light transmittance so as to compensate for the difference of transmittance of a panel glass is stuck to the surface of the panel. This also has a problem that the functional films having various transmittance grading must be prepared for respective color cathode ray tubes.

Japanese Laid-Open Publication Hei 6-139964/1994 discloses a film which has functions composed of the anti-reflection, the anti-static and the enhancement of contrast. A neutral filter or a color selective filter is formed in this film for enhancing the contrast. The publication, however, fails to disclose the countermeasures for the difference of brightness between the central portion and the peripheral portion, that is, the grading of brightness. Japanese Laid-Open Publication Hei 11-143371/1999 discloses a film whose adhesive layer has a light absorbing function. This known example also fails to disclose the countermeasures for the grading of brightness.

SUMMARY OF THE INVENTION

A color cathode ray tube of the present invention forms a coating layer which corrects the grading of brightness on the surface of a panel glass. Since the coating layer of the present invention aims at the correction of the grading brightness, the light absorption at the peripheral portion of a panel is minimized. Furthermore, a film is stuck on this coating layer so as to cover the coating layer. A light absorbing function is provided by this film so as to enhance the contrast of a displayed image. The film which covers the coating layer may preferably be a film which is capable of absorbing an approximately constant amount of light over the entire surface of the panel. In accordance with the present invention, the light absorption coefficient of visible light of the coating layer formed on the external surface of the panel is set to be small, and so the back surface reflection by the coating layer can be minimized. On the other hand, with the provision of the film, a necessary amount of light absorption can be obtained, and, hence, a necessary contrast can be easily obtained as well.

DESCRIPTION OF PREFERRED EMBODIMENT

Figure 1:
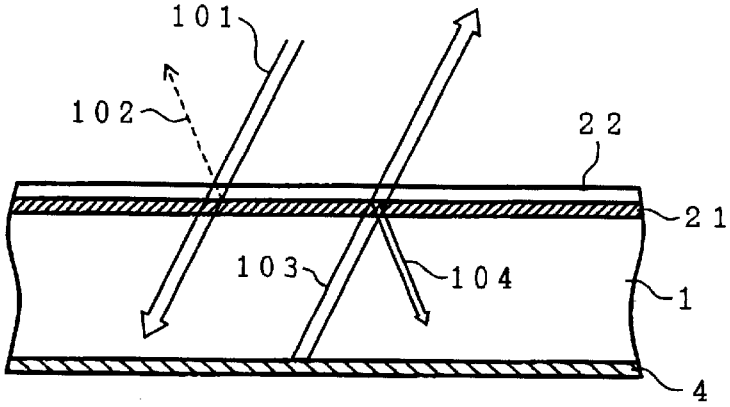
FIG. 1 is an explanatory view of a back surface reflection.

FIG. 1 is an explanatory view of the back surface reflection. A phosphor 4 is formed on the inside of a panel 1, while films 21, 22 for preventing the reflection and enhancing a contrast are formed on the outside of the panel 1. Here, numeral 22 indicates a transparent film and numeral 21 indicates a light absorption layer. Material and film thickness of the films 21, 22 are set to such values which suppress the reflection 102 of an external light 101 as small as possible. The light absorption of the light absorbing film 21 is set to a maximum value which can obtain a necessary contrast. In case the light absorbing film 21 cannot be made very thick, it is necessary to increase the light absorption coefficient of the light absorbing film 21. In this case, however, an amount of a back surface reflection 104 which is the light generated upon reflection of a light 103 emitted from the phosphor 4 on the light absorption layer is increased. This deteriorates the focusing and causes a ghost phenomenon. The present invention is provided for improving this phenomenon.

Figure 2:
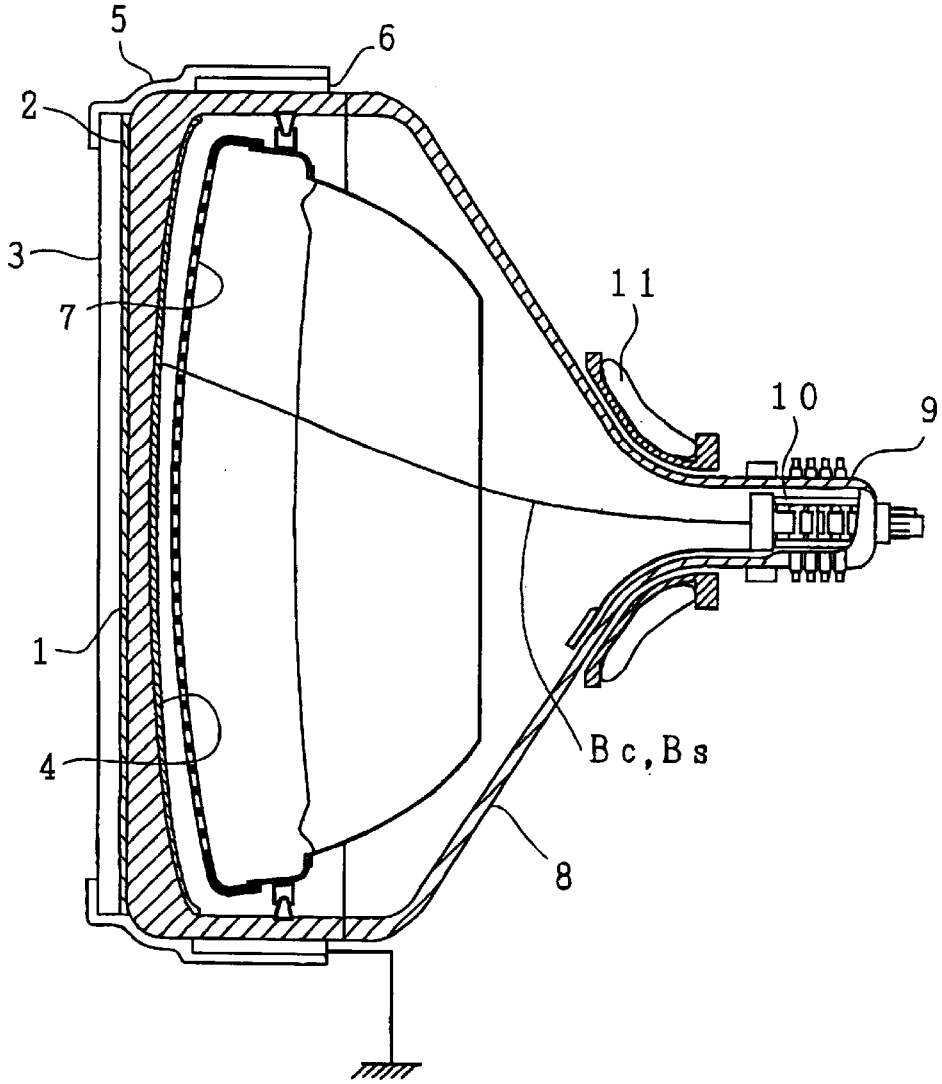
FIG. 2 is a cross-sectional view showing one example of a color picture tube of the present invention.

FIG. 2 is an example of a color picture tube of the present invention. Although the external surface of a panel 1 is approximately flat, the inner surface of the panel 1 has a radius of curvature of 1672 mm. With respect to the panel having the external flat surface, in view of easiness of manufacturing of a shadow mask, it is necessary to make the equivalent radius of curvature of the external surface of the panel 10 times or more greater than the curvature of the inner surface and it is preferable that the former is 20 times or more greater than the latter. Assuming that the equivalent radius of curvature of the external surface of the panel is set to not less than 10,000 mm, an approximately flat feeling can be obtained. Here, the equivalent radius of curvature Rd is a value expressed by a following formula, wherein the half length of the effective diagonal screen size is set to Dd and the difference of height between the central portion and the effective diagonal screen size end is set to Zd as shown in FIG. 3.

$$Rd=(Dd^2+Zd^2)/(2Zd)$$

Figure 3:
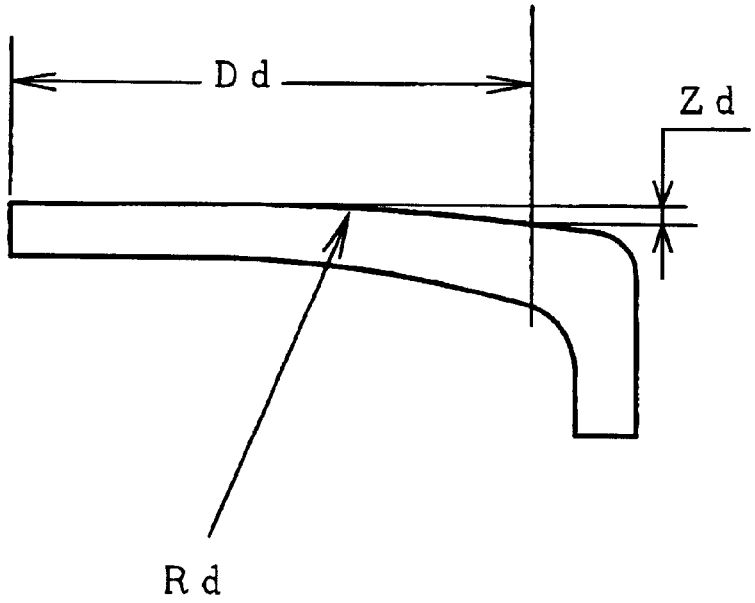
FIG. 3 is an explanatory view of an equivalent radius of curvature.

Although, FIG. 3 shows a case where the equivalent radius of curvature Rd of the external surface of the panel is defined, the definition of the inner side of the panel can be made in the similar manner.

Assuming that the external surface of the panel is completely flat, the radius of curvature of the inner surface is 1672 mm and the glass thickness of the central portion of the panel is 11 mm, the glass thickness of the panel at the effective diagonal peripheries (Dd=200 mm) becomes 26 mm. To increase the contrast, there may be a method which uses material having a large light absorption coefficient of glass. In this case, however, since the thickness of the glass differs largely between the central portion and the peripheral portion of the panel, it is difficult to increase the light absorption coefficient of glass. In this invention, clear or semi-clear material is used as the material of glass. Table 1 shows the light transmittance with the thickness of each glass material being set to 10.16 mm.

TABLE 1 light transmittance of glass material

| glass material | transmittance (%) |
|---|---|
| clear | 86.0 |
| semi-clear | 80.0 |
| tint | 57.0 |
| dark tint | 46.0 |

Even when material having the high light transmittance is used, it is difficult to sufficiently eliminate the difference of brightness between the central portion and the peripheral portion. For example, in case of the panel which uses the semi-clear glass having the effective diagonal screen size of 41 cm, the transmittance at the central portion is 79%, while the transmittance of the peripheral portion (Dd=200 nun) is 68%. Here, the transmittance of glass is obtained in a following manner. That is, assuming that the glass transmittance is $\tau$, the glass thickness is t, the light absorption coefficient of the glass is k and the surface reflectance of glass is r, the glass transmittance can be expressed by a following formula.

$$\tau=(1-r)^2\exp(-kt).$$

Here, although the reflectance of glass is changed depending on material to be coated on the surface, in this case, the reflectance of glass is approximated to 0.045 which is the value of a case that the surface is made of air. Assuming that the light absorption coefficient of glass k is 0.0129 and putting the thickness of glass at the central portion and the peripheral portion in the formula, the above-mentioned glass transmittance can be obtained.

Figure 4:
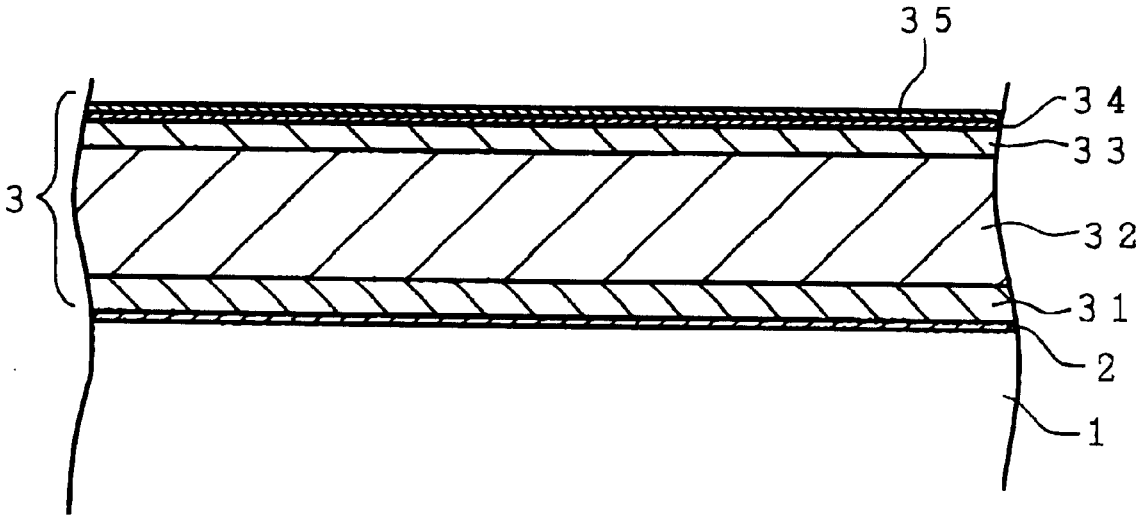
FIG. 4 is a detailed cross-sectional view of a panel of the color cathode ray tube of the present invention.

For eliminating the difference of brightness between the central portion and the peripheral portion and preventing the deterioration of contrast, according to the color cathode ray tube of the present invention, a grading correction coating layer 2 and a film 3 are provided. In this invention, the degree of the light absorption performed by the coating layer 2 is restricted to the correction of the brightness grading and the light absorption for increasing the contrast is performed by the film or an adhesive for the film. This is provided for reducing the above-mentioned back surface reflection. Accordingly, it is desirable that the light absorption of the coating layer 2 at the peripheral portion of the panel is restricted as small as possible. In the present invention, the film 3 is adhered onto the coating layer 2. This structure is shown in FIG. 4. Numeral 31 indicates an adhesive in which pigment for absorbing light is dispersed. Numeral 32 indicates a film substrate and is made of polyethylene terephthalate (PET). On the film substrate 32, a hard coat layer 33 for increasing the hardness, the weatherability and the like of the film is formed. On the hard coat layer 33, an anti-static conductive film 34 and an insulation film 35 which covers the conductive film 34 are formed. The conductive film 34 is a high refractive layer while the insulation layer 35 is a low refractive layer and these films cooperatively work as a reflection prevention film. In the present invention, the conductive film is made of ITO and the insulation film is made of a $SiO_2$ film. Because of its low light absorption coefficient, ITO hardly causes problems on the back surface reflection. $SiO_2$ film also is advantageous that the problems on the back surface reflection hardly occurs. In FIG. 2, a conductive metal tape 5 is provided for running the electrified charge to the panel and hence, the metal tape 5 is electrically connected to a tension band 6 which is grounded. The metal tape 6, the insulation film 35 and the conductive film 34 constitute a capacitor so as to run the electrified charge. In FIG. 2, a funnel 8 and a neck portion 9 constitute a vacuum envelope and a center electron beam Bc and side electron beams Bs emitted from an electron gun 10 are deflected by a deflection yoke 11 and reach the phosphor screen 4.

Figure 5:
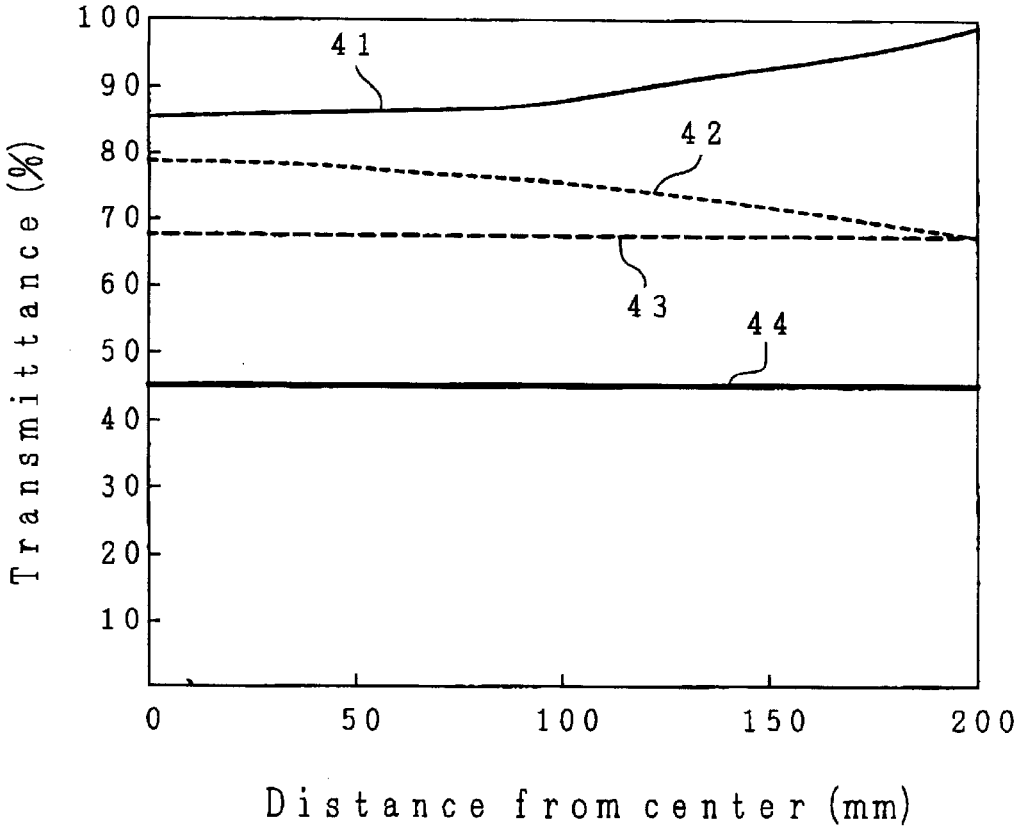
FIG. 5 is an explanatory view of the light transmittance of a panel of the color cathode ray tube of the present invention.

FIG. 5 shows the light transmittance of each layer. Numeral 41 indicates a curve showing the transmittance of the coating layer 2 and the transmittance is gradually increased from the central portion to the peripheral portion of the panel. Numeral 42 indicates the transmittance of the panel and the transmittance is lowered corresponding to the increase of the thickness of glass from the central portion to the peripheral portion of the panel. Numeral 43 indicates the transmittance of the adhesive of the film and the transmittance is substantially uniform throughout the entire surface of the screen. By combining these transmittances, the transmittance indicated by numeral 44 which is substantially uniform over the entire surface of the panel is obtained. According to this embodiment, there may be a case that the transmittance of a so-called black matrix of the phosphor screen is changed between the central portion and the peripheral portion of the screen. In such a case, corresponding to such a change, the grading of the light transmittance of the coating layer 2 is changed. According to this embodiment, although the respective light absorption rates of the substrate 32, the hard coat 33, the conductive film 34 and the insulation film 35 and the like are ignored, these layers may be made to share the light absorption for enhancing the contrast. It is preferable, however, to exclude the insulation film 35 which constitutes the uppermost layer from sharing the light absorption function from the viewpoint of preventing the reflection. Since the film is set free from the role of grading the light absorption in the present invention, the present invention has an excellent mass productivity.

Figure 6:
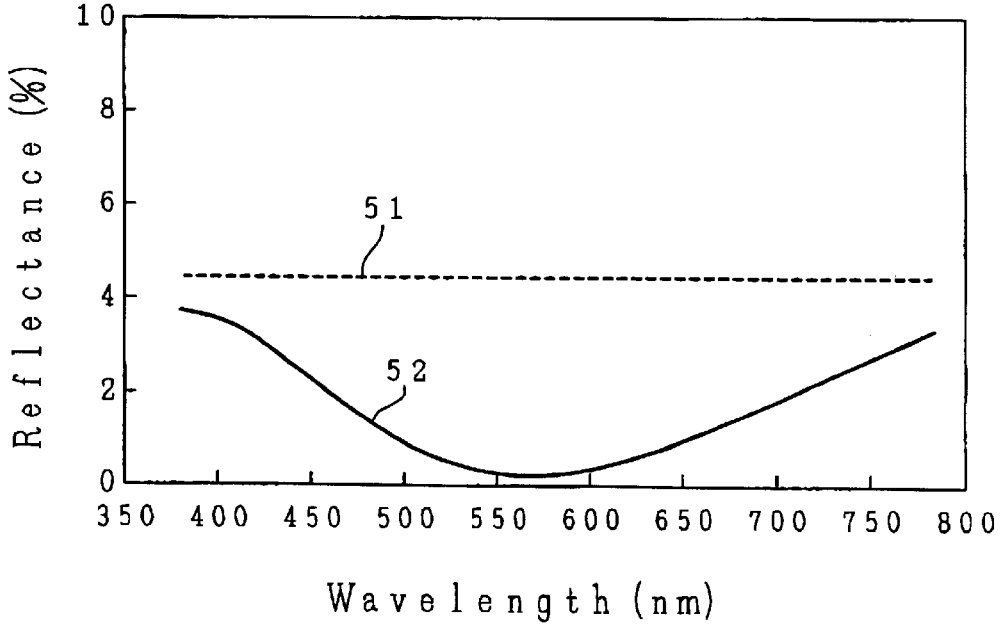
FIG. 6 is an explanatory view of a spectral reflectance which explains the reflection prevention effect.

FIG. 6 shows the reflectance characteristics of a case which uses the reflection prevention film consisting of the conductive film 34 and the insulation film 35 and the reflectance characteristics of another case which does not use such a reflection prevention film in the case which uses the reflection prevention film, the luminous reflectance is not more than 0.5% and hence, the sufficient reflectance prevention effect can be obtained.

In the constitution of the present invention, a leakage electric field AEF (Alternating Electric Field) is set to 0.5 V/m at VLEF (Very low Frequency Electric Field) and 1 V/m at ELEF (Extremely Low Frequency Electric Field). This meets the specification of TCO'99. The color cathode ray tube of the present invention showed the anti-static characteristics which makes the surface potential equal to or less than 1 kV within 1 minute after switching ON the color cathode ray tube.

EXAMPLE 1

This example relates to a case which formed the panel coating layer 2 by means of a spray coating. After completing a reinforcing step and an exterior graphite coating step, the panel surface of the color cathode ray tube was polished and wiped out so as to clean the surface. After heating the panel surface at a temperature of 40° C. a pigment suspension having a composition shown in Table 2 was sprayed and coated by means of a model 161 type spray-gun which is a product of BINKS.

TABLE 2 composition of pigment suspension

| composition of pigment suspension | proportion (weight %) |
|---|---|
| carbon black | 0.3 |
| anionic type surface-active agent | 0.01 |
| pure water (ion-exchange water) | balance |

The spray coating condition in this example was set such that the air flow rate was 160 L/min, the liquid flow rate was 30 mL/min and the coating time was approximately 30 seconds. In this example, as shown in FIG. 4, the pigment suspension was coated thick at a portion where the light transmittance of the panel glass was high so as to lower the light transmittance of the sprayed film, while, to the contrary, the pigment suspension was coated thin at a portion where the light transmittance of the panel glass was low. The average film thickness of the coating layer 2 was equal to or below 0.1 $\mu$m. In this embodiment, the light transmittance of the sprayed coating layer 2 was set to 85% at the central portion and 100% at the peripheral portion. Due to such a provision, the combined light transmittance of the panel 1 and the sprayed coating film 2 could be set to 67–67% over the entire surface of the panel. The difference of film thickness by spraying could be controlled by an adjustment of the scanning speed of the spray-gun or the distance between the panel and the nozzle. Although carbon black was used as the pigment, the black pigment shown in Table 3 may be used to have the equivalent characteristics.

TABLE 3 black pigment

| Name of black pigment | Maker |
|---|---|
| titan black 13R | Mitsubishi Metals |
| titan black 13M | Mitsubishi Metals |
| chromo fine black A | Dainichiseika |

Then, the film 3 was adhered onto the sprayed coating film 2. The light transmittance of the film 3 was approximately constant on the entire surface thereof and its value was about 68%. The black pigment (carbon black) which was dispersed in the adhesive also was used for the light absorption. Since the thickness of the adhesive was equal to or more than 1 $\mu$m, the absorption coefficient could be lowered so that the back surface reflection could be substantially ignored. As a result, according to the color cathode ray tube of this embodiment, the total light transmittance of the combined body made of the panel 1, the coating layer 2 and the film 3 became 46% and hence, a favorable contrast and brightness distribution was obtained.

EXAMPLE 2

Figure 7:
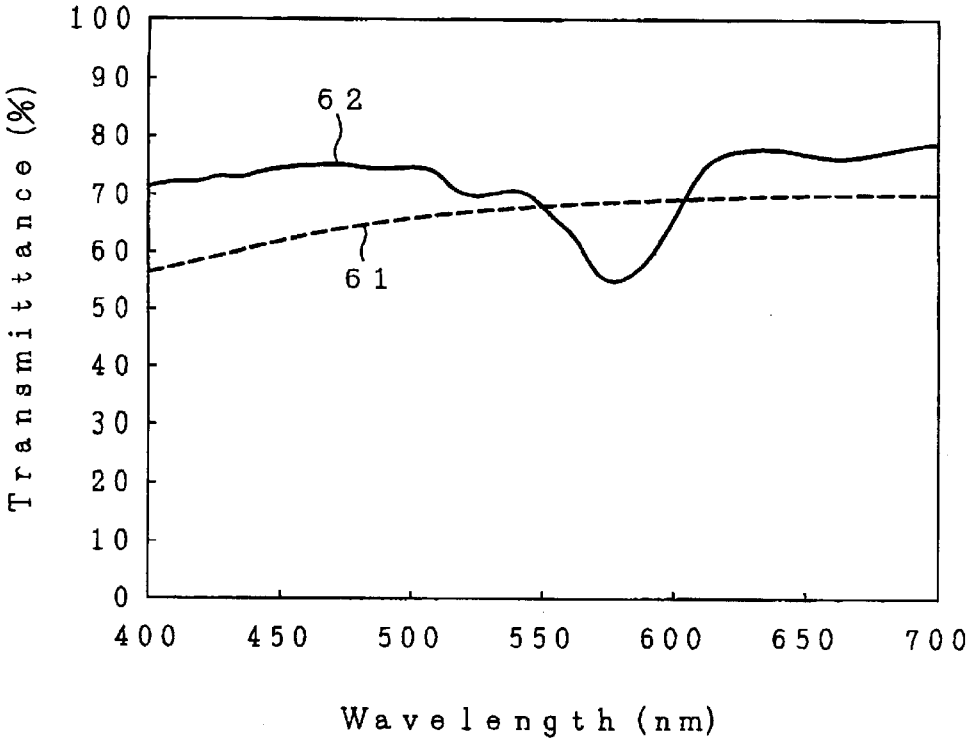
FIG. 7 is an explanatory view of a spectral transmittance of light absorption material.

The method for forming the coating layer 2 is the same as that of the example 1. This example relates to an example where the light absorbing is substance is dispersed in the adhesive 31 of the film 3. In this example, one case used only the black pigment as the light absorption substance and another case used three-colored mixture pigment (black+red+green) as the light absorption substance. The spectrum transmittance at the time that luminous transmittance was adjusted to 68% is shown in FIG. 7. In this case, carbon black was used as the black pigment, while a mixture which was produced by mixing carbon black, quinacridon-red and phthalocyanine-green at a weight rate of 1:1:1 was dispersed in the adhesive layer.

Figure 8:
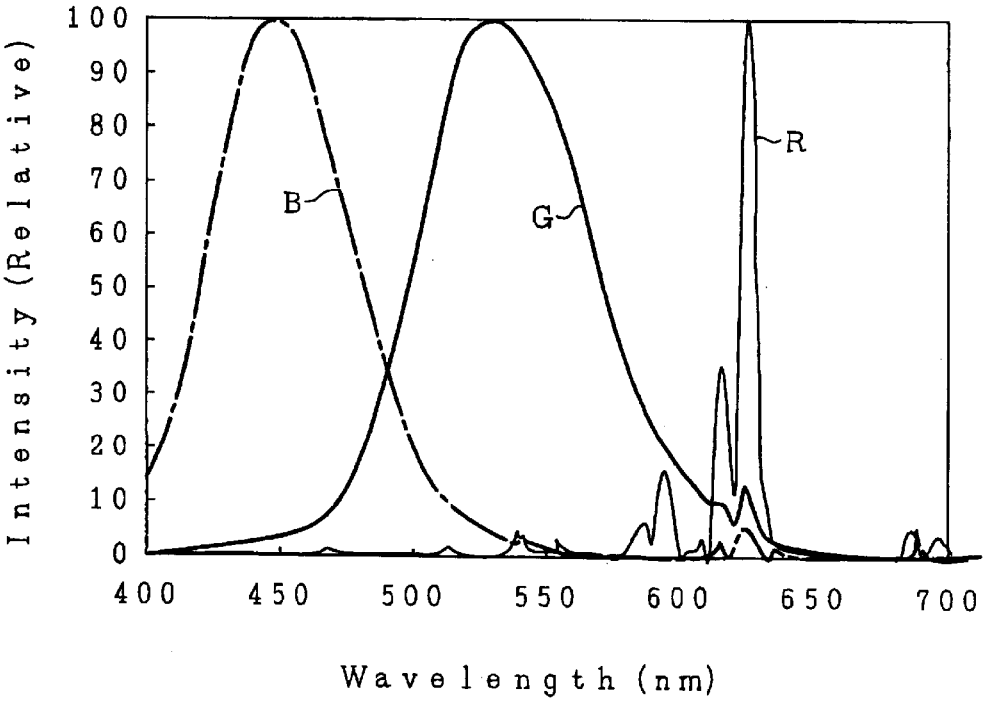
FIG. 8 is an example of emission spectrum of, a phosphor.

In FIG. 7, a curve indicated by numeral 61 shows the case where only the black pigment (carbon black) was used and a curve indicated by numeral 62 shows the case where three-colored mixture pigment was used. As shown in FIG. 7, in case only the black pigment (carbon black) was used, the transmittance could be lowered in a neutral manner against the wavelength of the light and the natural black in appearance could be also obtained. To the contrary, in case the three-colored mixture pigment was used, the pigment has the wavelength selective absorption characteristic which depends on the wavelength of light and hence, the light fall in a region which deviates from the maximum wavelength of the light emitted from the phosphor shown in FIG. 8 could be effectively absorbed so that the contrast could be enhanced without lowering the brightness of the cathode ray tube. Accordingly, in case three color mixture pigment was used, BCP (Brightness Contrast Performance) which is an index of the brightness and the contrast could be enhanced by 10% compared to the case where only the black pigment (carbon black) was used. That is, the brightness and the contrast of the color Braun tube could be enhanced by 10%.

EXAMPLE 3

This example shows a case where the panel coating layer 2 is formed by a spin coating. In the same manner as the example 1, the surface of the color cathode ray tube is polished and then is wiped out so as to clean the surface. Then, the color cathode ray tube is made to pass through a heating furnace where the temperature is adjusted such that the temperature becomes 35° C. at the central portion and at 45° C. at the peripheral portion. 50 mL of pigment suspension having a composition shown in Table 4 is injected to the surface of the panel and spin coating is carried out at the rotational speed of 150 rpm for 30 seconds.

TABLE 4

Composition of pigment suspension for spin Coating

| component | proportion (weight %) |
|---|---|
| carbon black | 0.3 |
| surface-active agent | 0.02 |
| ethanol | 50.0 |
| elhylene glycol | 0.2 |
| pure water (ion-exchange water) | balance |

In the mixture solvent of ethanol and pure water (ion-exchange water), the viscosity exhibited the maximum temperature dependency when ethanol was 40–50% by weight. The above-mentioned suspension injected to the surface of the panel gave rise to the viscosity difference due to the temperature difference of the panel. Accordingly, at the peripheral portion of the panel where temperature was high, the viscosity of the coated liquid was low, while at the central portion of the panel where temperature was low, the viscosity of the coated liquid was high. As a result, upon rotation of the panel, a larger amount of the coated liquid was dwelled at the central portion than the peripheral portion of the panel. On the other hand, since ethylene glycol was blended in the coated liquid, the drying speed of the coated liquid could be controlled at a constant value. Accordingly, the viscosity difference was directly reflected to the distribution of the film thickness. In this example, the transmittance of the panel coating layer 2 was set to 85% at the central portion and 93% at the peripheral portion of the panel. The ratio of transmittance of the panel between the central portion and the peripheral portion was 1:0.9. As a result, the transmittance of the combined body of the panel glass and the coating layer became 0.94 for the peripheral portion relative to 1 for the central portion. Other constitutions are the same as the example 1.

EXAMPLE 4

The method of manufacturing is similar to that of the example 1. In this example, to increase the adhesive force of the coating layer 2 shown in FIG. 4 to the panel glass, $SiO_2$ is used as a binder. Accordingly, the composition of the sprayed pigment suspension includes ethylsilicate as shown in Table 5.

TABLE 5

Composition of pigment suspension

| composition of pigment suspension | proportion (weight %) |
|---|---|
| carbon black | 0.3 |
| anionic type surface-active agent | 0.01 |
| ethylsilicate | 0.1 |
| hydrochloric acid (HCl) | 0.001 |
| pure water (ion-exchange water) | balance |

In the table 5, hydrochloric acid worked as a catalyst which promotes hydrolysis of ethylsilicate. Ethylsilicate was formed into silicon dioxide ($SiO_2$) by hydrolysis and polymerization reaction.

EXAMPLE 5

The method for manufacturing the color cathode ray tube of this example is similar to that of the example 3. In this embodiment, to increase the adhesive force of the coating layer 2 shown in FIG. 4 to the panel glass, $SiO_2$ was used as a binder. Accordingly, the pigment suspension which was coated while being rotated had the composition shown in Table 6.

TABLE 6

Composition of pigment suspension for spin coating

| composition of pigment suspension for spin coating | proportion (weight %) |
|---|---|
| carbon black | 0.3 |
| surface-active agent | 0.02 |
| ethylsilicate | 0.1 |
| hydrochloric acid (HCl) | 0.001 |
| ethanol | 50.0 |
| ethylene glycol | 0.2 |
| pure water (ion-exchange water) | balance |

In the table 6, hydrochloric acid worked as a catalyst which promotes hydrolysis of ethylsilicate. Ethylsilicate was formed into silicon dioxide ($SiO_2$) by hydrolysis and polymerization reaction.

What is claimed is:

1. A color picture tube characterized in that a glass panel includes a face portion which forms an image and a skirt portion which is connected to a funnel portion, a radius of curvature of an external surface of the panel face portion is made greater than a radius of curvature of an inner surface of the panel face portion, a shadow mask which faces the inner surface of the panel face portion in an opposed manner has a curvature, a coating is formed on the external surface of said panel face portion having a variable light transmittance in accordance with a position of said coating on said panel face portion, said coating having a first light transmittance at the central portion of said panel face portion which is smaller than a second light transmittance of said coating at a diagonal peripheral portion of said panel face portion so that a smaller amount of light passes through said coating having the first light transmittance than an amount of light passing through said coating having the second light transmittance, a film which absorbs light and contains an adhesive is adhered to the outer surface of said coating, whereby the difference of light transmittance between the central portion and the diagonal peripheral portion of said panel face portion is made smaller compared to a case having only the glass panel.

2. A color picture tube according to claim 1, wherein the light transmittance of the film having said adhesive is approximately uniform on the entire surface of said panel face portion.

3. A color picture tube according to claim 1, wherein the equivalent radius of curvature of the external surface of said panel face portion is 10 times or more greater than the equivalent radius of curvature of the inner surface of the panel surface portion.

4. A color picture tube according to claim 1, wherein the equivalent radius of curvature of the external surface of said panel face portion is 20 times or more greater than the equivalent radius of curvature of the inner surface of the panel surface portion.

5. A color picture tube according to claim 1, wherein said coating if formed by spraying.

6. A color picture tube according to claim 1, wherein said coating is formed by spin coating.

7. A color picture tube according to claim 1, wherein in the film containing said adhesive, said adhesive has light absorption characteristics.

8. A color picture tube according to claim 2, wherein in the film containing said adhesive, said adhesive performs light absorption.

9. A color picture tube according to claim 1, wherein said coating contains carbon black.

10. A color picture tube according to claim 8, wherein the carbon black is dispersed in the adhesive of said film.

11. A color picture tube according to claim 8, wherein plural kinds of pigments are dispersed in the adhesive of said film.

12. A color picture tube according to claim 11, wherein said plural kinds of pigments absorb a greater amount of light having a wavelength other than the wavelength of light emitted from a phosphor.

13. A color picture tube according to claim 1, wherein said panel glass is made of semi-clear material.

14. A color picture tube according to claim 1, wherein said panel glass is made of clear material.

15. A color picture tube according to claim 1, wherein said film includes a conductive layer and an insulation layer which covers said conductive layer.

16. A color picture tube according to claim 15, wherein said conductive layer includes ITO.

17. A color picture tube according to claim 15, wherein said conductive layer includes $SiO_2$.

18. A color picture tube according to claim 15, wherein said insulating layer is $SiO_2$.

19. A color picture tube according to claim 1, wherein said coating contains carbon black and $SiO_2$.

20. A color picture tube characterized in that a glass panel includes a face portion which forms an image and a skirt portion which is connected to a funnel portion, a radius of curvature of an external surface of the panel face portion is made greater than a radius of curvature of an inner surface of the panel face portion, a shadow mask which faces the inner surface of the panel face portion in an opposed manner has a curvature, and at least a coating is formed on the external surface of the panel face portion, the coating having a light transmittance therethrough which is variable in accordance with a position of the coating on the panel face portion, wherein the combination of at least the coating and the panel face portion provides a light transmittance therethrough so that a difference of light transmittance between a central portion and a diagonal peripheral portion of the panel face portion is smaller as compared to a difference in light transmittance between the central portion and the diagonal peripheral portion of the panel face portion without the coating formed thereon.

21. A color picture tube according to claim 20, further comprising a film which absorbs light and containing an adhesive is adhered to the outer surface of the coating.

22. A color picture tube according to claim 1, wherein the variation in light transmittance of said coating is substantially independent of wavelength of light passing therethrough.

23. A color picture tube according to claim 20, wherein the variation in light transmittance of said coating is substantially independent of wavelength of light passing therethrough.

* * * * *